US011700480B2

(12) United States Patent
Tanaka et al.

(10) Patent No.: US 11,700,480 B2
(45) Date of Patent: Jul. 11, 2023

(54) ULTRASONIC SPEAKER

(71) Applicant: HOSIDEN CORPORATION, Osaka (JP)

(72) Inventors: Akihiro Tanaka, Osaka (JP); Ryo Inoue, Osaka (JP)

(73) Assignee: HOSIDEN CORPORATION, Osaka (JP)

( * ) Notice: Subject to any disclaimer, the term of this patent is extended or adjusted under 35 U.S.C. 154(b) by 0 days.

(21) Appl. No.: 17/494,092

(22) Filed: Oct. 5, 2021

(65) Prior Publication Data

US 2022/0116699 A1 Apr. 14, 2022

(30) Foreign Application Priority Data

Oct. 14, 2020 (JP) ..... 2020-173050

(51) Int. Cl.
*H04R 1/32* (2006.01)
*H04R 1/02* (2006.01)

(52) U.S. Cl.
CPC ..... *H04R 1/323* (2013.01); *H04R 1/021* (2013.01); *H04R 2217/03* (2013.01)

(58) Field of Classification Search
None
See application file for complete search history.

(56) References Cited

U.S. PATENT DOCUMENTS

2011/0290028 A1* 12/2011 Matsumoto ..... G10K 9/22 73/658

FOREIGN PATENT DOCUMENTS

| | | | |
|---|---|---|---|
| JP | H11-266498 | A | 9/1999 |
| JP | 2006-352829 | A | 12/2006 |
| JP | 2007-318742 | A | 12/2007 |
| JP | 2012-114539 | A | 6/2012 |
| JP | 2018-101924 | A | 6/2018 |
| JP | 6707242 | | 6/2020 |

OTHER PUBLICATIONS

Extended European Search Report in Corresponding Ep Application No. 21200101.0, dated Mar. 10, 2022.

* cited by examiner

*Primary Examiner* — Kenny H Truong
(74) *Attorney, Agent, or Firm* — Greenblum & Bernstein, P.L.C.

(57) ABSTRACT

An ultrasonic speaker comprises a case that has an opened top surface and includes a plurality of protrusions protruding inward on an inner side surface of the case, a piezoelectric element fixed to a bottom surface in the case, and a substrate that is inserted in the case and placed on upper surfaces of the plurality of protrusions.

3 Claims, 5 Drawing Sheets

*Prior Art*

ULTRASONIC SPEAKER

TECHNICAL FIELD

The present invention relates to an ultrasonic speaker suitable for a parametric speaker.

BACKGROUND ART

For example, Japanese Registered Patent No. 6707242 and the like disclose related art examples of an array type parametric speaker using ultrasonic speakers.

Some of the related art examples have adopted a structure in which a case is provided with a step so that the inner diameter of the bottom surface of the case is smaller than the inner diameter of the top surface (opening portion) of the case, and a substrate is placed on the top surface of the step.

In the case where this structure is adopted, even when ultrasonic speakers are arranged to be spread all over as densely as possible as shown in FIG. 1, a gap g occurs between adjacent ultrasonic speakers, and the gap g is equal to a value larger than the double (2d) of the step d (g>2d). As a result, the size (outer diameter D) of the bottom surface of the case becomes smaller than the size (outer diameter L) of the substrate, which has caused a problem that an effective vibration area cannot be gained.

SUMMARY OF THE INVENTION

Therefore, the present invention has an object to provide an ultrasonic speaker capable of increasing an effective vibration area as compared with the size of a substrate and improving the characteristics of a parametric speaker.

An ultrasonic speaker of the present invention comprises a case that has an opened top surface and includes a plurality of protrusions protruding inward on an inner side surface of the case, a piezoelectric element fixed to a bottom surface in the case, and a substrate that is inserted in the case and placed on upper surfaces of the plurality of protrusions.

Effects of the Invention

According to the ultrasonic speaker of the present invention, the effective vibration area can be increased as compared with the size of the substrate, and the characteristics of the parametric speaker can be improved.

DETAILED DESCRIPTION

Figure 1:
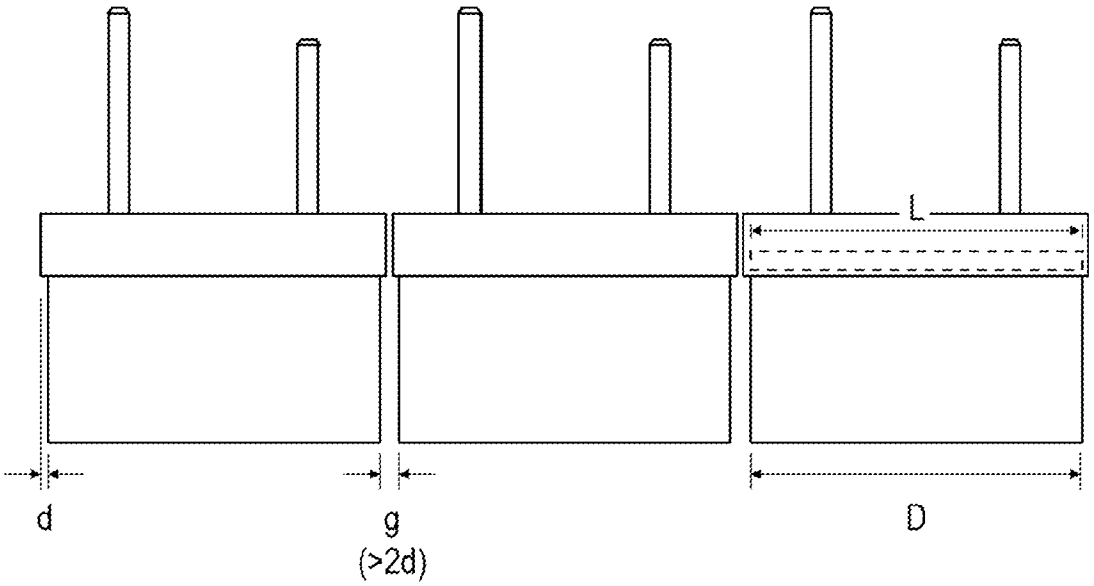
FIG. 1 is a diagram showing an example of a conventional ultrasonic speaker.
Figure 2:
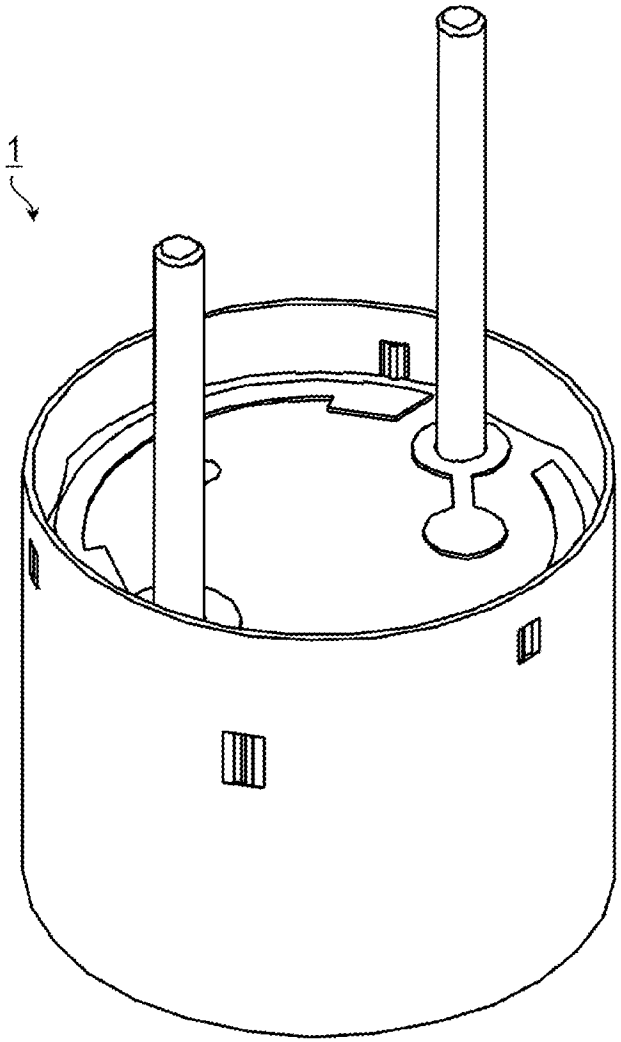
FIG. 2 is a perspective view of an ultrasonic speaker of a first embodiment.

Hereinafter, an embodiment of the present invention will be described in detail. Components having the same functions are designated by the same reference numerals, and duplicative description thereon will be omitted.

First Embodiment

Figure 3:
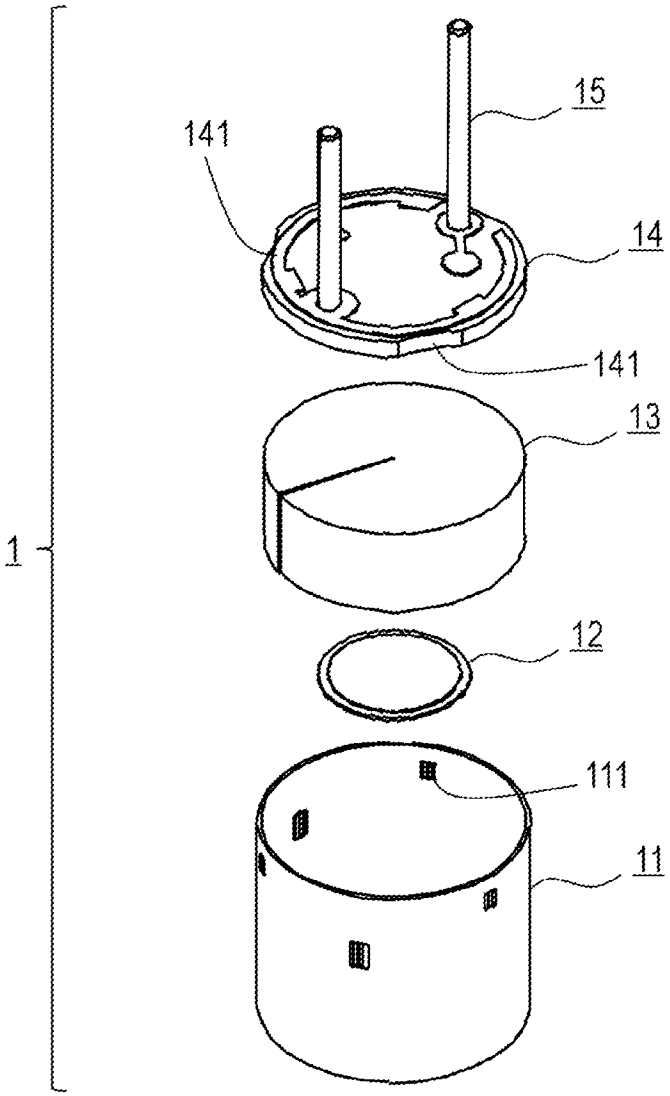
FIG. 3 is an exploded perspective view of the ultrasonic speaker of the first embodiment.

Hereinafter, the structure of an ultrasonic speaker of a first embodiment will be described with reference to FIGS. 2 to 5. As shown in FIG. 3, an ultrasonic speaker 1 of the present embodiment comprises a case 11 having a cylindrical shape that has an opened top surface and includes a plurality of protrusions 111 protruding inward on an inner side surface of the case, a disc-shaped piezoelectric element 12 fixed to a bottom surface in the case 11, a disc-shaped sponge piece 13 that is accommodated in the case 11 and arranged so as to cover the piezoelectric element 12, a disc-shaped substrate 14 that is inserted in the case 11 and placed on upper surfaces of the plurality of protrusions 111, two pins 15 that are connected to the substrate 14 and extend upward, and a lead wire (not shown) for connecting the pins 15 and the piezoelectric element 12. The substrate 14 is, for example, a PCB. Note that the top surface (opened surface) of the case 11 is hermetically sealed with a sealing material (not shown). The sealing material may be, for example, a silicon-based material.

Figure 4:
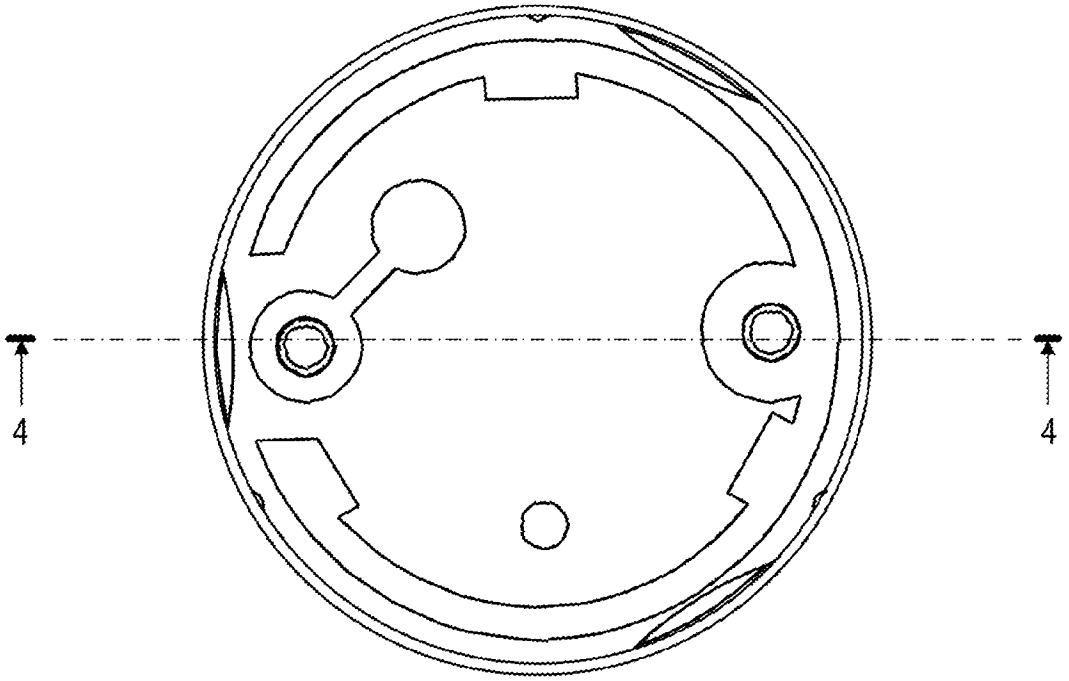
FIG. 4 is a plan view of the ultrasonic speaker of the first embodiment.
Figure 5:
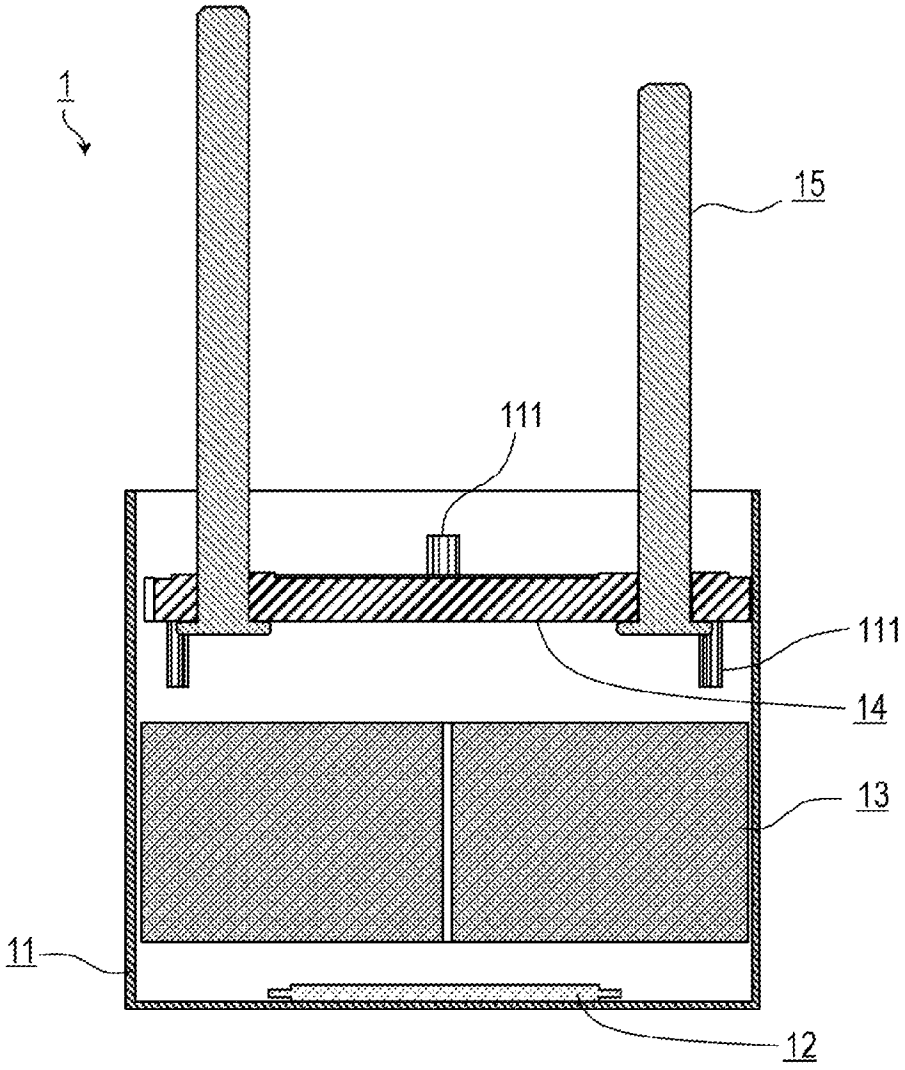
FIG. 5 is a cross-sectional view of the ultrasonic speaker of the first embodiment.

As shown in the cross-sectional view of FIG. 5 (a cutting line is shown in FIG. 4), the protrusions 111 are arranged on both upper and lower stages of the inner side surface of the case 11, which correspond to two types of reference depths on the inner side surface of the case 11. As shown in FIG. 3, the substrate 14 includes notches 141 at positions where the substrate 14 passes through the protrusions 111 on the upper stage, and is placed on the upper surfaces of the protrusions 111 on the lower stage as shown in FIG. 5.

It is preferable to arrange the protrusions 111 on the upper and lower stages at positions where the substrate 14 is held between the protrusions 111 on the upper and lower stages by inserting the substrate 14 into the case 11 while the notches 141 are aligned with the protrusions 111 on the upper stage to allow the substrate 14 to pass through the protrusions 111 on the upper stage, and then rotating the substrate 14 by a predetermined angle with a vertical direction set as a rotation axis (see FIG. 5).

For example, a total of three protrusions 111 on the upper stage are provided to be arranged at angular intervals of 120°, and a total of three protrusions 111 on the lower stage are provided to be likewise arranged at angular intervals of 120° and further rotationally shifted by 60° from the three protrusions 111 on the upper stage respectively. The substrate 14 has a total of three notches 141 arranged at angular intervals of 120°. The substrate 14 is passed through the protrusions 111 on the upper stage, and then rotated by about 30° with the vertical direction set as the rotation axis, whereby the substrate 14 can be fixed. Note that the distance in the vertical direction between the lower surface of each protrusion 111 on the upper stage and the upper surface of each protrusion 111 on the lower stage is substantially equal to the thickness of the substrate 14.

The ultrasonic speaker 1 of the present embodiment is configured so that the protrusions 111 protruding inward are provided in the case 11, and the substrate 14 is placed on the upper surfaces of the protrusions 111. Therefore, the inner diameter of the bottom surface of the case can be made equal to the inner diameter of the top surface of the case, so that the gap g occurring between adjacent ultrasonic speakers can be almost eliminated (the adjacent pitch can be reduced), the effective vibration area can be increased, and the characteristics of the parametric speaker can be improved.

According to the ultrasonic speaker 1 of the present embodiment, the protrusions 111 on the upper and lower stages are arranged at positions where the substrate 14 is held between the protrusions 111 on the upper and lower stages by passing the substrate 14 through the protrusions 111 on the upper stage and then rotating the substrate 14 by a predetermined angle with the vertical direction set as the rotation axis. Therefore, the substrate 14 can be fixed by interposing the substrate 14 between the protrusions 111 on the upper and lower stages, and a step of soldering lead wires to the substrate 14 can be easily performed (in the related art, a substrate is simply placed on the pedestal of a case, so that when a piezoelectric element is soldered and connected to the substrate with lead wires, it is necessary to hold the substrate so that the substrate does not move). Further, this structure also contributes to holding the substrate 14 horizontally. For example, even when the upper surface of the substrate 14 is filled with a sealing material (silicon) or the like in order to improve the characteristics, it is possible to prevent the substrate 14 from tilting due to the weight of the sealing material (silicon).

What is claimed is:

1. An ultrasonic speaker comprising:

a case that has an opened top surface and includes a plurality of protrusions protruding inward on an inner side surface of the case;

a piezoelectric element fixed to a bottom surface in the case;

an upper stage of the inner side surface of the case and a lower stage of the inner side surface of the case; and a substrate that is inserted in the case and placed on upper surfaces of a first set of the plurality of protrusions on the lower stage of the inner side surface of the case.

2. The ultrasonic speaker according to claim 1, wherein the plurality of protrusions are arranged on the upper stage and the lower stage of the inner side surface of the case which correspond to two types of reference depths on the inner side surface of the case, and the substrate includes notches at positions where the substrate passes through a second set of the plurality of protrusions on the upper stage, and is placed on the upper surfaces of the first set of the plurality of protrusions on the lower stage.

3. The ultrasonic speaker according to claim 2, wherein the second set of the plurality of protrusions on the upper stage and the first set of the plurality of protrusions on the lower stage are arranged at positions where the substrate is held between the second set of the plurality of protrusions on the upper stage and the first set of the plurality of protrusions on the lower stage by passing the substrate through the second set of the plurality of protrusions on the upper stage and then rotating the substrate by a predetermined angle with a vertical direction set as a rotation axis.

* * * * *